US006234405B1

(12) United States Patent
Yoshida et al.

(10) Patent No.: US 6,234,405 B1
(45) Date of Patent: May 22, 2001

(54) PAINTING DEVICE

(75) Inventors: Osamu Yoshida, Tokyo; Hidetsugu Matsuda, Fujieda; Akihiko Arichi, Chita-gun, all of (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 09/464,000

(22) PCT Filed: Jun. 18, 1999

(86) PCT No.: PCT/JP99/03255

§ 371 Date: Feb. 22, 2000

§ 102(e) Date: Feb. 22, 2000

(87) PCT Pub. No.: WO99/67026

PCT Pub. Date: Dec. 29, 1999

(30) Foreign Application Priority Data

Jun. 22, 1998 (JP) ..... 10-191095

(51) Int. Cl.[7] ..... B05B 15/02

(52) U.S. Cl. ..... 239/112; 239/700; 239/223

(58) Field of Search ..... 239/104, 106, 239/112, 690, 699, 700, 702, 703, 705, 708, 222.11, 223, 224, DIG. 14; 901/43; 222/144.5, 135; 414/225; 118/729, 730

(56) References Cited

U.S. PATENT DOCUMENTS 4,532,148 * 7/1985 Vecellio ..... 239/700
4,785,760 11/1988 Tholome .
6,050,498 * 4/2000 Minoura et al. ..... 239/112

FOREIGN PATENT DOCUMENTS 60-112371 7/1985 (JP) .
62-20853 5/1987 (JP) .
3-242254 10/1991 (JP) .
8-229446 9/1996 (JP) .

* cited by examiner

*Primary Examiner*—Lisa Ann Douglas
(74) *Attorney, Agent, or Firm*—Oblon, Spivak, McClelland, Maier & Neustadt, P.C.

(57) ABSTRACT

A coating system which is provided with a plural number of feeder units for different paint colors in such a way as to permit color changes within a shortened period of time. Unit waiting devices for different paint colors are located in the vicinity of a coating robot. The unit waiting devices each include a feeder unit loader adapted to load and unload one of feeder units into and out of a rotary atomizing head type coating machine, which is mounted on a fore end portion of the arm of the coating robot, and a hose gripper adapted to hand over or receive one of supply hoses to and from a hose gripper which is provided on the side of the arm. As a consequence, the paint color can be changed by replacing a paint feeder unit on the coating machine by a specified one of feeder units of different colors which are supported on the unit waiting devices.

13 Claims, 10 Drawing Sheets

PAINTING DEVICE

This invention relates to a coating system which is particularly suitable for use, for example, in coating vehicle bodies or the like which require to change the paint color in the course of a coating operation.

DISCUSSION OF THE BACKGROUND

Generally, coating systems which are currently in use for coating vehicle bodies or the like, are largely constituted by a working mechanism which is provided with a swinging arm, a coating machine which is mounted on a fore end portion of the arm, and a paint hose which supplies paint to the coating machine. The upstream end of the paint hose is connected to a color changing valve assembly which is arranged to supply a selected paint color from paint sources of different colors.

In the case of coating systems of this sort, however, it becomes necessary to supply solvent and thereby washing away paint residues from the paint hose, and to discharge spent solvent from the machine each time when changing the paint color. Therefore, each color change not only entails wasteful consumption of paint and solvent but also takes an objectionably long period of time.

In this regard, attempts have been made to mount a color changing valve assembly on an arm of a working mechanism for the purpose of shortening the length of a paint hose between the color changing valve and a coating machine, as proposed in Japanese Patent Publication No. S62-20853. A coating system of this sort, however, has an inherent problem that the performance quality of a working mechanism is deteriorated to a considerable degree due to an increased weight which is put on the arm of the working mechanism and a large number of hoses which are connected to a color changing valve assembly to impede operations of the arm.

As a second prior art coating system which is free from the problems just mentioned, there has been known a coating system (e.g., Japanese Laid-Open Patent Publication No. S63-175662) employing a coating machine which is adapted to be mounted on a fore end portion of an arm and provided with a paint tank, the content of which is replaced each time when changing the paint color. Consequently, the second prior art coating system succeeded in abolishing the color changing valve assembly and in reducing the number of hoses.

Further, as a third prior art coating system, it has been known to provide a large number of paint cartridges which are filled with paint of different colors, which are adapted to be selectively and replaceably mounted on a housing of the coating system (e.g., Japanese Laid-Open Patent Publication No. H8-229446).

In the case of the above-mentioned second prior art coating system (Japanese Laid-Open Patent Publication No. S63-175662), a paint tank which is provided on a coating machine has to be washed on each color change and before filling a new color thereinto. Therefore, a problem with this coating system is that a color changing operation takes a great deal of time.

Besides, in the second prior art coating system, an air hose which supplies air to the coating machine for spraying paint is usually allowed to hang down from the arm of the working mechanism. This air hose could cause coating defects by contacting a coating surface of a work piece during a coating operation or could be damaged contact with other moving parts of the machine.

Further, in the case of the third prior art coating system (Japanese Laid-Open Patent Publication No. H8-229446) employing paint cartridges for different paint colors, it becomes necessary to provide a paint charging device in the vicinity of the coating system for charging or filling paint into a dismantled cartridge each time when changing the paint color although such a paint charging operation is troublesome and takes time.

SUMMARY OF THE INVENTION

In view of the above-mentioned problems with prior art coating systems, it is an object of the present invention to provide a coating system which is so arranged as to shorten the time which is required for a color change in the course of a coating operation and at the same time so arranged as to preclude coating defects as well as damages to a paint hose.

In order to achieve the above-mentioned objective, according to the present invention, there is provided a coating system which comprises:

a working mechanism having a pivotally supported swing arm; a rotary atomizing head type coating machine mounted on a fore end portion of the arm of the working mechanism and having a rotary atomizing head adapted to be rotated by an air motor; a plural number of feeder units of different paint colors adapted to be replaceably mounted on the rotary atomizing head type coating machine and each equipped with a feed tube to supply paint thereto; paint hoses provided and connected separately to the respective feeder units to supply paint of different colors from respective paint sources; a hose support pipe fitted on each one of the paint hoses at a position anterior to a proximal end connected to the feeder unit; a hose gripper provided on the arm of the working mechanism and adapted to releasably grip and support one of the paint hoses by way of the hose support pipe; and a unit waiting device located in the vicinity of the working mechanism and adapted to hold the feeder units and paint hoses in respective waiting positions; the unit waiting devices being provided with a plural number of a feeder unit loaders adapted to load and unload one of the feeder units into and out of the rotary atomizing head type coating machine, and hose grippers each adapted to releasably grip the hose support pipe of the paint hose to be handed over to and from the hose gripper on the side of the arm.

With the arrangements just described, at the time of changing the paint color, a feeder unit of a previous color needs to be replaced by a unit of a new or next color. For this purpose, the working mechanism is operated to move the arm toward a unit waiting device to which the feeder unit of the previous color should be returned, and then located in a unit replacing position in front of the unit waiting device. In this state, a feeder unit hanger is actuated to extract the feeder unit out of the rotary atomizing type coating machine, while the hose support pipe which is supported by the hose grippers on the side of the arm is handed over to a hose gripper on the side of the waiting device.

Nextly, as soon as the feeder unit and paint hose are dismantled, the arm of the working mechanism is moved toward another unit replacing position of the unit waiting device, i.e., a unit replacing position confronting a feeder unit hanger which holds a feeder unit of a next color.

In this state, the feeder unit hanger is actuated to load the feeding unit of the next color into the rotary atomizing head type coating machine, and a hose support pipe which is supported on a hose gripper on the side of the unit waiting device is handed over to the hose gripper on the side of the arm. As a result, the paint hose of the feeder unit of the next color is now supported on the hose gripper on the side of the working mechanism, and a color changing operation is completed.

Nextly, in order to start a coating operation in the new color, a paint which is supplied through the paint hose is fed from the feeder unit to the rotary atomizing head of the coating machine, and the paint is atomized into fine particles and sprayed toward the work piece by the rotary atomizing head. During a coating operation, although the arm is swung to the shape of a coating surface on the work piece, the paint hose is supported by the hose gripper on the side of the arm through the hose support pipe, and therefore, the paint hose is prevented from hanging down from the arm in a loose state.

In a preferred form of the present invention, the unit waiting device are arranged radially at angular intervals around a pivoting point of the arm of the working mechanism.

Consequently, in this case, simply by swinging the arm of the working mechanism through a predetermined angle, the arm and the rotary atomizing head type coating machine on the arm can be located at a desired unit replacing position of the unit waiting device.

In another preferred form of the present invention, the unit waiting devices comprise a feeder unit waiting plate and a supply hose waiting plate, each located in the vicinity of the working mechanism and within an operative range of the arm, the feeder unit loaders being located on the feeder unit waiting plate radially at angular intervals around a pivoting point of the arm, and the hose grippers on the side of the unit waiting device being located on the supply hose waiting plate radially at angular intervals around the pivoting point of the arm.

With the arrangements just described, by swinging the arm of the working mechanism through a given angle, it becomes possible to mount or dismantle the hose support pipe of the paint hose and the feeder unit onto or from the arm at the same position.

In this instance, preferably, the rotary atomizing head type coating machine may comprise a feed tube passage hole for receiving a feed tube of the feeder unit when the latter is loaded thereinto, and the feeder unit loaders may comprise a feeder unit gripper adapted to grip one of the feeder units therein and a gripper moving mechanism adapted to move the feeder unit gripper axially toward and away from the feed tube passage hole at the time of loading or unloading the feeder unit into or out of the rotary atomizing head type coating machine.

With the arrangements just described, while the feeder unit is being gripped on the feeder unit gripper, the feeder unit gripper can be moved by the gripper moving mechanism toward or away from the feed tube passage hole to load or unload the feeder unit into or out of the rotary atomizing head type coating machine.

Further, according to the present invention, the rotary atomizing head type coating machine may comprise a feed tube passage hole formed axially through a rotational shaft of the air motor, and the feeder unit loaders of the unit waiting device may be adapted to move a feed tube of one of feeder units into and out of a feed tube passage hole from behind of the coating machine at the time of loading or unloading said feeder unit into or out of the coating machine.

With the arrangements just described, at the time of fittingly loading a feeder unit into the rotary atomizing head type coating machine, a feed tube of the feeder unit is inserted into the feed tube passage hole of the coating machine, and simultaneously the feeder unit is loaded into position from the rear side of the coating machine, by operation of a corresponding feeder unit hanger on the side of the unit waiting device. On the other hand, when unloading or dismantling the feeder unit from the rotary atomizing head type coating machine, the feed tube of the feeder unit is extracted out of the feed tube passage hole and the feeder unit is unloaded from the coating machine from behind, similarly by operation of the feeder unit hanger on the side of the unit waiting device.

Further, according to the present invention, the hose grippers on the side of the arm as well as the hose grippers on the side of the unit waiting device can each be constituted by a pair of gripper pawls which are operated by an actuator.

With the arrangements just described, the gripper pawls are moved toward each other by the actuator at the time of gripping the hose support pipe therebetween, and away from each other at the time of releasing the hose support pipe.

Further, in another preferred form according to the present invention, each one of the feeder units is provided with a solvent hose, side by side with the paint hose, for supplying therethrough a solvent to be used for washing a rotary atomizing head of the coating machine.

With the arrangements just described, the rotary atomizing head of the coating machine can be washed with the solvent which is supplied through the solvent hose. In addition, the solvent hose can be supported on the hose grippers on the side of the arm or the side of the unit waiting devices along with the paint hose.

DESCRIPTION OF THE PREFERRED EMBODIMENTS

Figure 1:
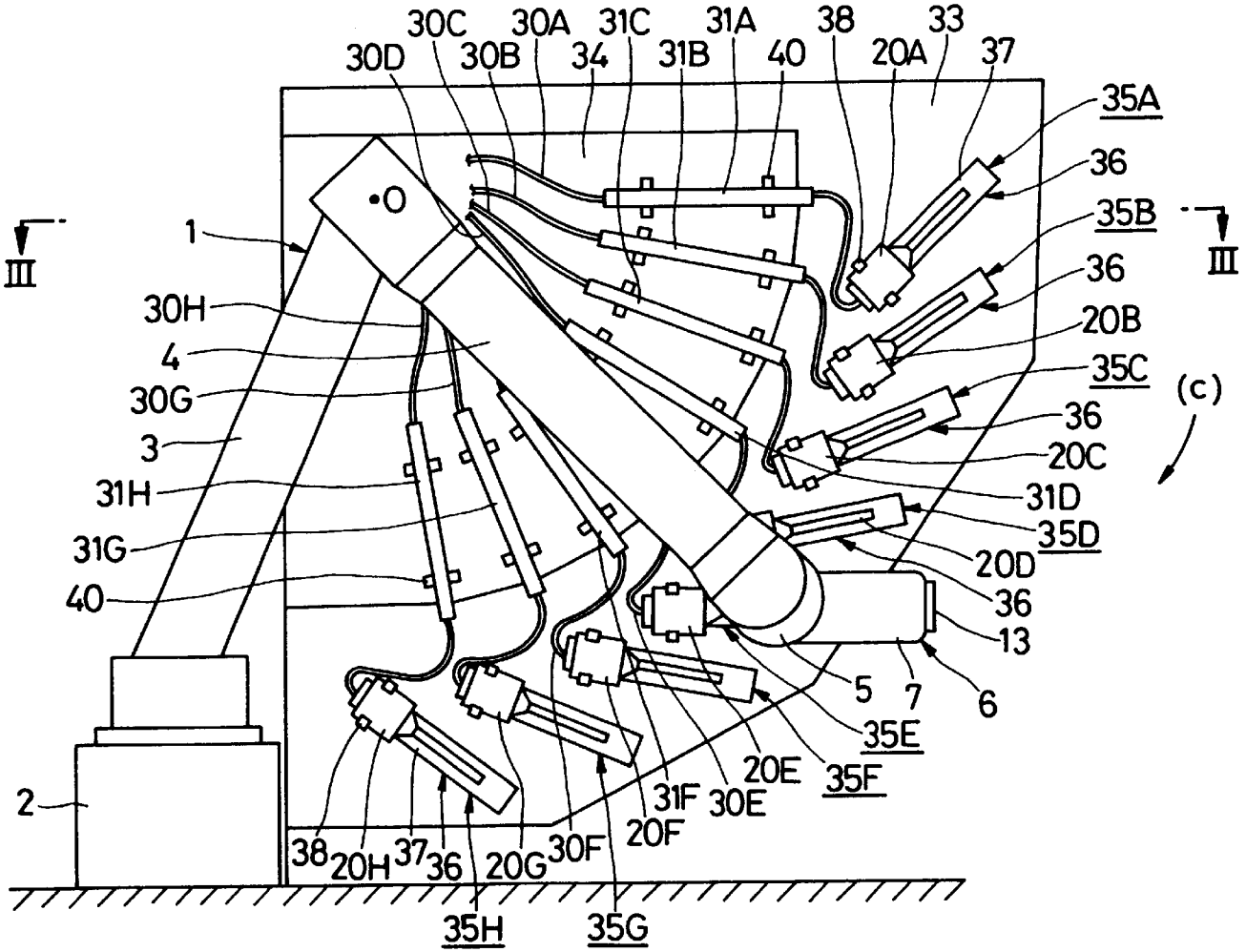
FIG. 1 is a front view of a coating system embodying the present invention.
Figure 2:
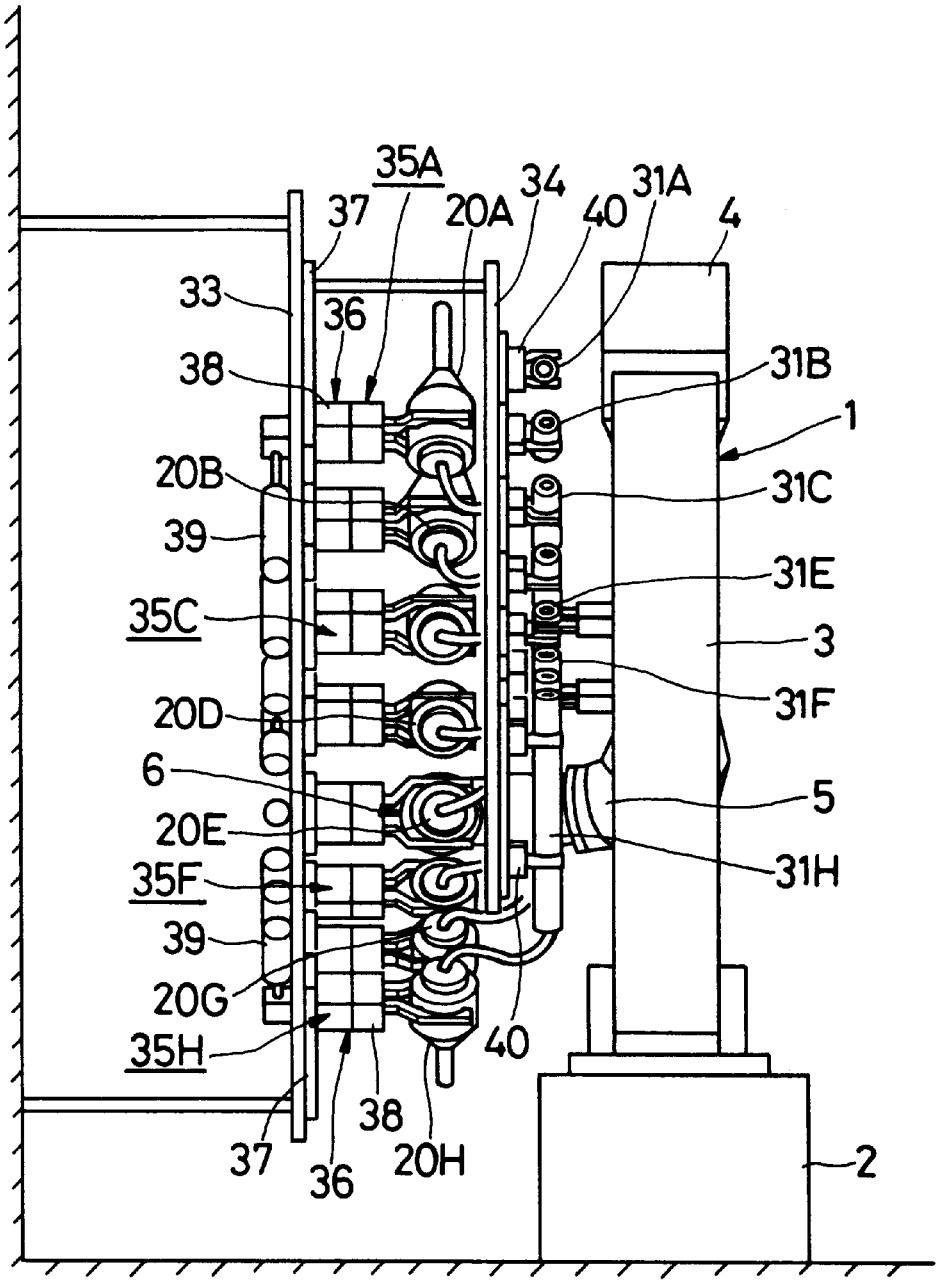
FIG. 2 is a left-hand side view of the coating system according to the present invention.

Hereafter, the present invention is described more particularly by way of its preferred embodiments with reference to FIGS. 1 through 16.

In the drawings, indicated at 1 is a coating robot which is employed as a working mechanism in the present invention. The coating robot 1 is largely constituted by a pedestal or base 2, a support column 3 which is rotatably and rockably supported on the base 2, an arm 4 which is pivotally connected to the fore end of the support column 3, and a wrist 5 which is provided at the distal end of the arm 4. Provided on the wrist 5 is a housing 7 of a rotary atomizing head type coating machine 6 which will be described hereinafter.

Figure 4:
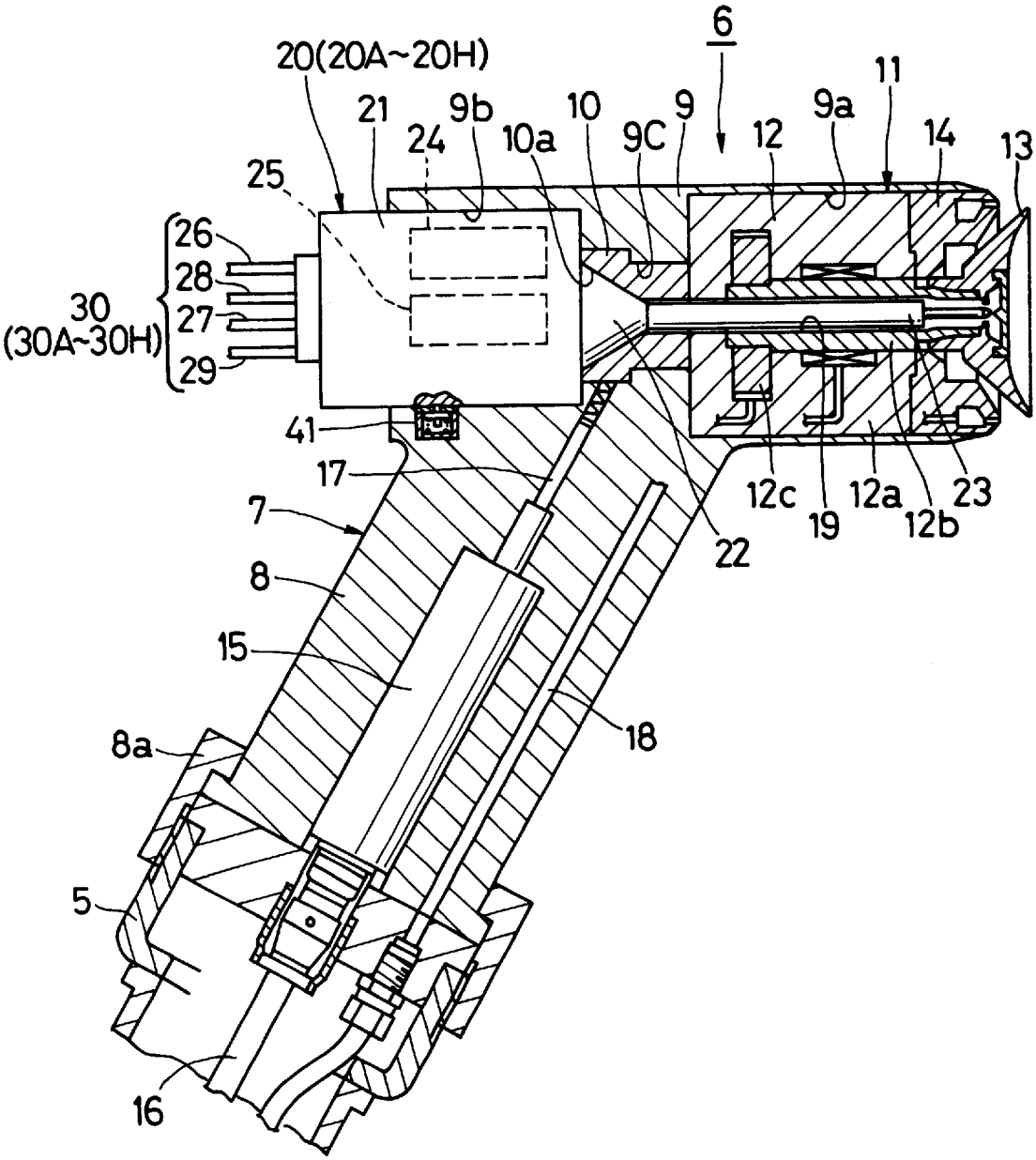
FIG. 4 is a vertical sectional view on an enlarged scale of a rotary atomizing head type coating machine which has a feeder unit mounted thereon.

Indicated at 6 is the rotary atomizing head type coating machine (hereinafter referred to as "coating machine" for brevity). As seen in FIG. 4, the coating machine 6 is mounted on a fore end portion of the arm 4 of the coating robot 1, and which is largely constituted by housing 7, coating machine body 11, feed tube passage hole 19 and feeder units 20A to 20H, which will be described hereinbelow.

The housing 7 which is formed of a synthetic resin material, for example, is attached to the fore end of the wrist 5 of the coating robot. The housing 7 includes a neck portion 8 which is fixedly fastened to the wrist 5 of the coating robot 1 through a cylindrical clamp member 8*a*, and a head portion 9 which is formed integrally at the fore end of the neck portion 8. In this instance, a coating machine mount portion 9*a* in the form of a cylindrical recess and a unit mount portion 9*b* similarly in the form of a cylindrical recess are bored in front and rear end portions of the head portions of the head portion 9, respectively. These coating machine mount portion 9*a* and unit mount portions 9*b* are communicated with each other through a stepped through hole 9*c*.

Indicated at 10 is a spacer ring which is fitted in the stepped through hole 9*c*. The spacer ring 10 is provided with a conical recess 10*a* on its rear side which is to be brought into abutting and fitting engagement with a conical projection 22 of a feeder unit 20 for setting the latter in position in axial and radial directions in the manner as will be described hereinafter.

Denoted at 11 is the coating machine body which is set in position within the coating machine mounting portion 9*a* of the head portion 9. This coating machine body 11 is constituted by an air motor 12, which will be described hereinafter, a rotary atomizing head 13 which is rotationally driven by the air motor 12, and a shaping air ring 14 which is provided in a front side portion of the air motor 12.

The air motor 12 includes an air motor case 12*a* which is fitted in the coating machine mounting portion 9*a*, a rotational shaft 12*b* which is extended axially through and projected on the front side of the motor case 12*a*, and a air turbine 12*c* which is fixedly mounted on a rear end portion of the rotational shaft 12*b*.

The rotary atomizing head 13 is mounted on a front end portion of the rotational shaft 12*b* on the front side of the air motor 12, and rotationally driven from the air motor 12. By high speed rotation of the rotary atomizing head 13, a paint which is supplied to the rotary atomizing head 13 is centrifugally atomized into fine particles, and charged with a high voltage to form charged paint particles as will be described hereinafter. Further, by the rotary atomizing head 13, charged paint particles are urged to fly toward and deposit on a work piece, traveling along an electrostatic field which is formed between the rotary atomizing head 13 and the work piece 42 to be coated as will be described hereinafter.

Indicated at 14 is the shaping air ring which is provided on the front side of the air motor 12. The shaping air ring 14 contains shaping air outlet holes through which shaping air is spurted out toward paint releasing edges of the rotary atomizing head 13, for shaping the charged paint particles, which are released from the rotary atomizing head 13, into a desired spray pattern.

Denoted at 15 is a high voltage generator which is mounted within the neck portion 8 of the housing 7. The high voltage generator 15 is constituted by Cockcroft circuit, for example, and adapted to elevate a source voltage, which is supplied through a power line 16, for example, to a voltage in the range of −90 to −120 KV. Further, a high voltage cable 17 from the output side of the high voltage generator 15 is connected, for example, to the air motor 12. Therefore, in this case, a high voltage is applied to the rotary atomizing head 13 through the rotational shaft 12*b* of the air motor 12 for charging the paint directly.

Indicated at 18 are a plural number of air passages which are provided in the neck portion 8 for supplying turbine air, brake air and shaping air therethrough. To represent these air passages, one air passage is shown in the drawings of the present embodiment.

In this instance, a turbine air passage supplies air to the air turbine 12*c* of the air motor 12. A brake air passage supplies brake air for stopping rotation of the air turbine 12*c*. Further, a shaping air passage supplies air to the shaping air ring 14.

Indicated at 19 is a feed tube passage hole which is formed internally and axially through the rotational shaft 12*b* of the air motor 12. The rear end of the feed tube passage hole 19 is opened into the conical recess 10*a* of the spacer ring 10, while the fore end of the feed tube passage hole 19 is opened into the rotary atomizing head 13. A feed tube 23 of a feeder unit 20 is removably fitted in the feed tube passage hole 19.

Indicated at 20A, 20B, . . . 20H are paint feeder units which supply paint of different colors separately and independently of each other (hereinafter referred to collectively as "feeder units 20"). Each feeder unit 20 is largely constituted by a valve casing 21 of a cylindrical shape and of a diameter which can be brought into and out of fitting engagement with the unit mounting portion 9*b*, a conical projection 22 which is provided on a front end face of the valve casing 21 and adapted to be brought into abutting and fitting engagement with the conical recess 10*a* for setting the feeder unit 20 in position in the axial and radial directions, a feed tube 23 in the form of a double wall tube which is projected axially forward from the conical projection 22 and internally defines a central paint passage and an outer annular solvent passage (both not shown), and a paint valve 24 and a solvent valve 25 which are provided within the valve casing 21.

In this instance, each feeder unit 20 is set in the housing 7 by passing the feed tube 23 into the feed tube passage hole 19 and fitting the valve casing 21 into the unit mounting portion 9*b* of the housing 7. In this state, the paint valve 24 or the solvent valve 25 is opened to spurt out a paint or solvent from the fore end of the feed tube 23 toward the rotary atomizing head 13.

Indicated at 26, 27, 28 and 29 are a paint hose, a solvent hose, a paint valve driving air hose and a solvent valve driving air hose which are connected to the feeder unit 20, respectively. These hoses 26 to 29 are bundled together into a supply hose 30 (one of supply hoses 30A, 30B, . . . 30H which are provided for the respective paint colors).

In this instance, the paint hose 26 is connected to the paint passage within the feed tube 23 through the paint valve 24. The solvent hose 27 connected to the solvent passage within the feed tube 23 through the solvent valve 25. Further, the paint valve driving air hose 28 is connected to the paint valve 24 for supplying driving pilot air thereto. Similarly, the solvent valve driving air hose 29 is connected to the solvent valve 25 for supplying driving pilot air thereto.

Indicated at 31A, 31B, . . . 31H are hose support pipes (hereinafter referred to collectively as "hose support pipes 31" for brevity) which are provided within the lengths of supply hoses 30A, 30B, . . . 30H, respectively, as shown in FIG. 1. Each one of the hose support pipes 31 is formed of high strength metallic material or the like and arranged to cover part of a corresponding supply hose 30. The hose support pipe 31 is gripped on its outer peripheral side by hose grippers 32 or 40 when the supply hose 30 is supported by the hose grippers 32 or 40 as will be described hereinafter. Namely, when the supply hose 30 is supported by the hose grippers 32 or 40, the hose support pipe 41 functions to protect the supply hose 30 from damages.

On the other hand, indicated at 32 are a pair of hose grippers which are provided on the side of the arm 4 of the coating robot 1 and located in spaced positions in the longitudinal direction of the arm 4. In this instance, as shown in FIGS. 11 to 16, each hose gripper 32 on the side of the arm 4 is constituted by actuators 32*a* which are located in spaced positions in the longitudinal direction of the arm 4 and a pair of gripper pawls 32*b* which are moved toward and away from each other by the actuators 32*a*. Thus, the hose gripper 32 on the side of the arm is operated to move the paired gripper pawls 32 toward each other at the time of gripping the hose support pipe 31 (supply hose 30) therebetween and to move the gripper pawls 32*b* away from each other at the time of releasing the hose support pipe 31.

Indicated at 33 is a feeder unit waiting plate of a unit waiting device, which is located in the vicinity of the coating robot 1 and within the reach of the robot arm 4. The feeder unit waiting plate 33 is constituted by a plate substantially of a sectoral shape which has its center located at a pivoting point O (indicated in FIG. 1) of the robot arm 4 when the support column 3 is in a tilted state. Indicated at 34 is a supply hose waiting plate of the unit waiting device, which is located similarly in the vicinity of the coating robot 1 and within the reach of the robot arm 4. The supply hose waiting plate 34 is likewise constituted by a plate substantially of a sectoral shape which has its center located at the aforementioned pivoting point O. However, the supply hose waiting plate 34 is formed in a smaller sectoral shape as compared with the feeder unit waiting plate 33. The feeder unit waiting plate 33 and supply hose waiting plate 34 are installed vertically in an overlapped state, for example, on a side wall of a coating booth or the like, with the supply hose waiting plate 34 on the front side of the feeder unit waiting plate 33.

Indicated at 35A, 35B, . . . 35H are unit waiting device which are provided on the waiting plates 33 and 34 of the unit waiting device for feeder units of different colors (hereinafter referred to collectively as "unit waiting device 35"). The unit waiting device 35 are located radially at predetermined angular intervals around the pivoting point O of the arm 4 when the support column 3 is in a tilted state. Each unit waiting device 35 is constituted by a feeder unit loader 36 and a hose gripper 40 on the side of the unit waiting device. More particularly, for the respective paint colors, a plural number of sets of the feeder unit loader 36 and the hose gripper 40 on the side of the unit waiting device are located radially at predetermined angular intervals.

Designated at 36 are the feeder unit loaders which are provided on the feeder unit waiting plate 33. The feeder unit loaders 36 includes guide rails 37 which are arranged radially on the front side of the feeder unit waiting plate 33, feeder unit grippers 38 which are mounted on the guide rails 37 for movements therealong, and a gripper moving mechanism including air cylinders 39 which are mounted on the back side of the feeder unit waiting plate 33 for moving the feeder unit grippers 38 along the respective guide rails 37.

Figure 5:
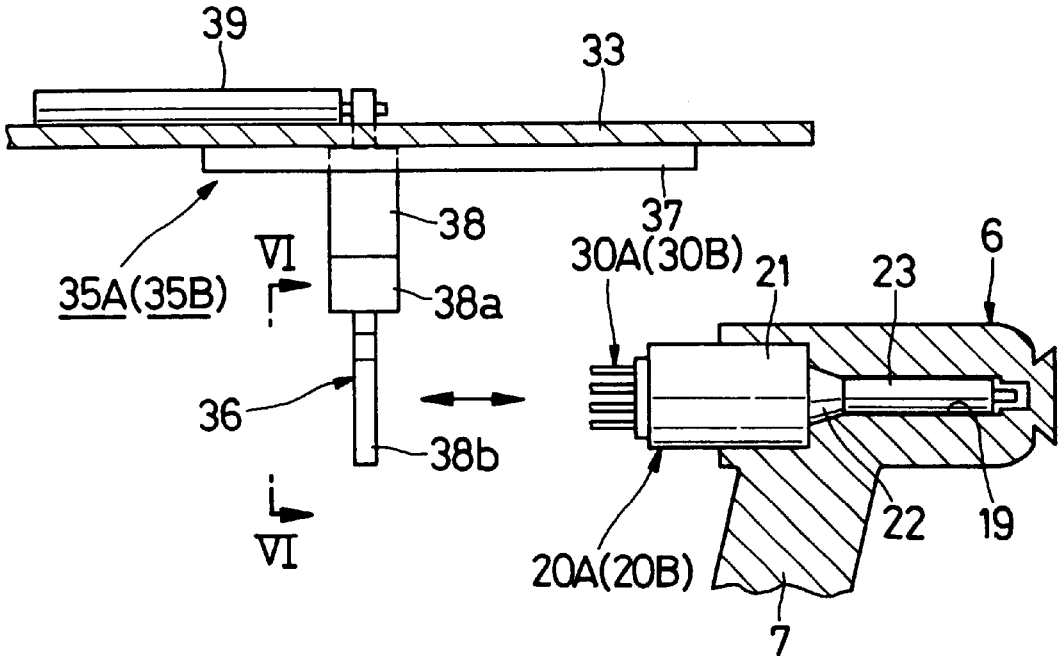
FIG. 5 is a sectional view on an enlarged scale of the rotary atomizing head type coating machine located in a unit replacing position.
Figure 6:
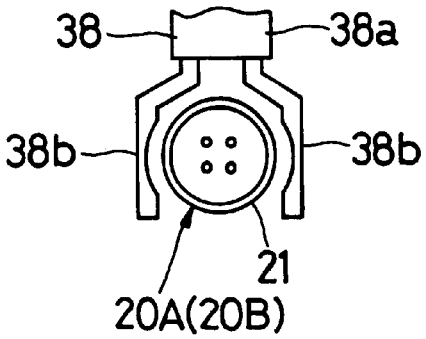
FIG. 6 is a side view taken in the direction of arrows VI—VI of FIG. 5, showing, along with the feeder unit, a feeder unit gripper having a pair of gripper pawls in a spread-apart open position.

In this instance, as shown in FIGS. 5 and 6, each one of the feeder unit gripper 38 is constituted by an actuator 38*a*, and a pair of gripper pawls 38*b* which are moved toward and away from each other by the actuator 38*a* for gripping and releasing actions. More particularly, at the feeder unit gripper 38, a valve casing 21 of a corresponding feeder unit 20 is gripped by and between the two gripper pawls 38*b* when the two gripper pawls 38*b* are moved toward each other by the actuator 38*a*, and released from the feeder unit gripper 38 when the two gripper pawls 38*b* are moved away from each other by the actuator 38*a*.

Indicated at 40 are a pair of hose grippers which are provided on the side of the supply hose waiting plate 34 correspondingly to each one of the feeder units of different paint colors. The respective hose grippers 40 are arranged radially and at predetermined angular intervals on the front side of the supply hose waiting plate 34. In this instance, each one of the hose grippers 40 is constituted by an actuator 40*a*, and a pair of gripper pawls 40*b* which are moved toward and away from each other by the actuator 40*a* for gripping and releasing actions. More particularly, at each one of the hose grippers 40 on the side of the waiting plate 34, a hose. support pipe 31 is gripped between and by the paired gripper pawls 40*b* when the gripper pawls 40*b* are moved toward each other, and released when the gripper pawls 40*b* are moved away from each other by the actuator.

Indicated at 41 (in FIG. 4) is a lock device which is adapted to get into engagement with the outer periphery of the valve casing 21 of a feeder unit 20 to hold the latter in a locked state. However, when the feeder unit 20 pulled out with a force of a certain magnitude, the feeder unit 20 can be disengaged from the lock device 41 and thus can be dismantled.

The present embodiment, with the above-described arrangements, is operated in the manner as follows.

Figure 3:
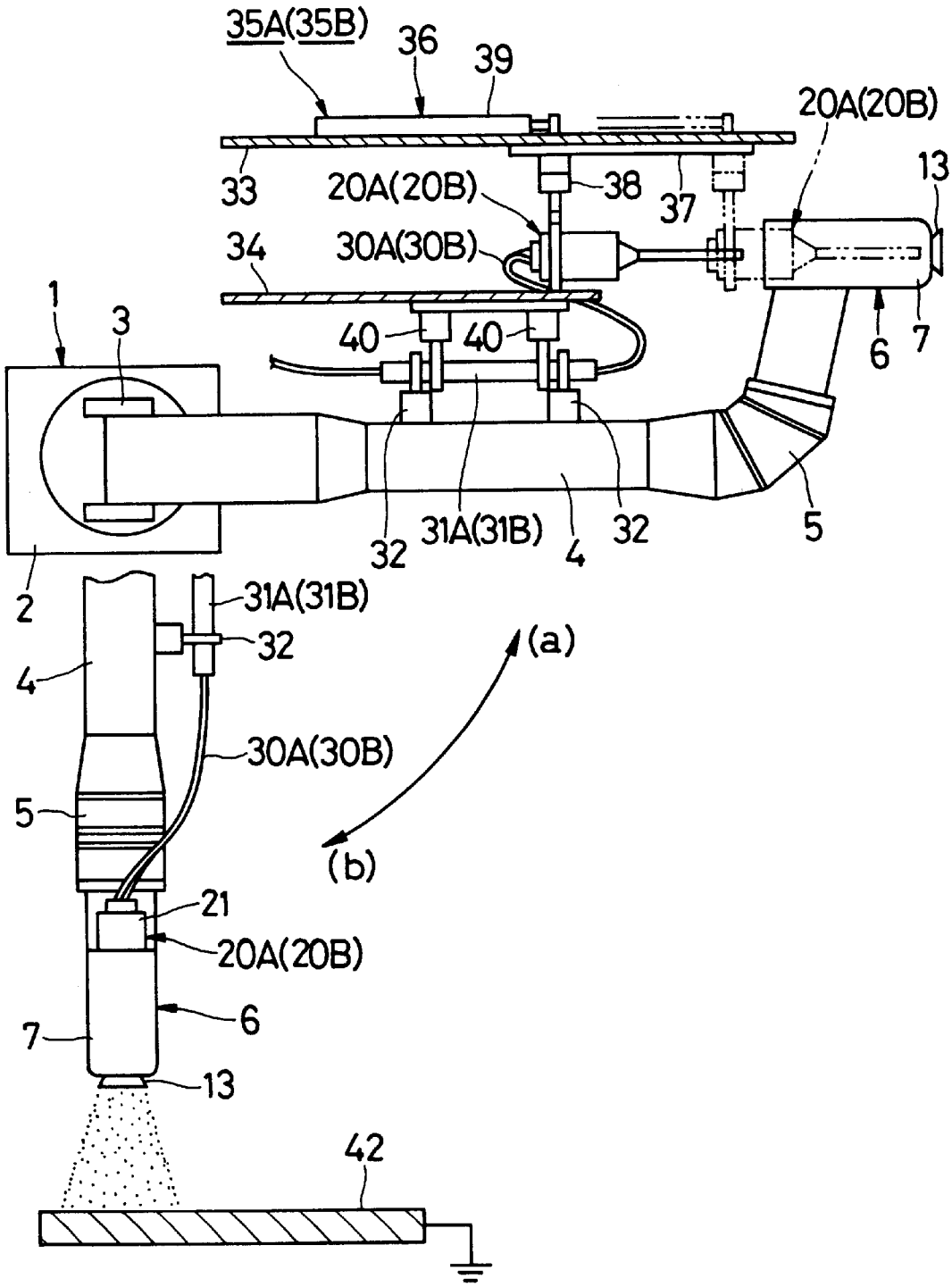
FIG. 3 is a sectional view taken in the direction of arrows III—III of FIG. 1, showing a coating robot arm which is located in a unit replacing position of a unit waiting device and in a coating position facing a work piece to be coated.

Firstly, the description is directed to a case where a work piece 42 is coated, for example, with paint of color A which is selected from a variety of paint colors A to H. In this case, as shown in FIG. 3, the support column 3 of the coating robot 1 is turned from position (a) to position (b), and then the support column 3, arm 4 and wrist 5 are operated to locate a feeder unit 20A, which supplies paint of color A, in a coating position facing toward the work piece 42.

In this state, the paint valve 24 is opened, whereupon paint of color A is allowed to flow into the supply hose 30A and spurted toward the rotary atomizing head 13 through the paint passage of the feed tube 23. At this time, since the rotary atomizing head 13 is rotated at high speed by the air motor 12 and applied with a high voltage from the high voltage generator 15, the paint of color A is centrifugally atomized into fine particles by the rotary atomizing head 13 and at the same time charged with a high voltage to form charged paint particles. The charged paint particles are shaped into a desired spray pattern by shaping air which is spurted out through the respective shaping air outlet holes in the shaping air ring 14, and urged to fly toward and deposit on the work piece 42, traveling along an electrostatic field formed between the rotary atomizing head 13 and the work piece 42 which is connected to the earth potential.

Upon finishing the coating operation in color A, the solvent valve 25 is opened to supply solvent to the solvent passage in the feed tube 23 through the solvent hose 27. Whereupon, the solvent is spurted toward the rotary atomizing head 13 from the solvent passage to wash away paint residues of color A from the rotary atomizing head 13.

Now, for example, the paint can be changed from color A to color B by a color changing operation as described below.

In this instance, as described hereinbefore, the sectoral plates of the feeder unit waiting plate 33 and the supply hose waiting plate 34 are installed in an overlapped state and concentrically around the pivoting point O of the coating robot arm 4.

Figure 7:
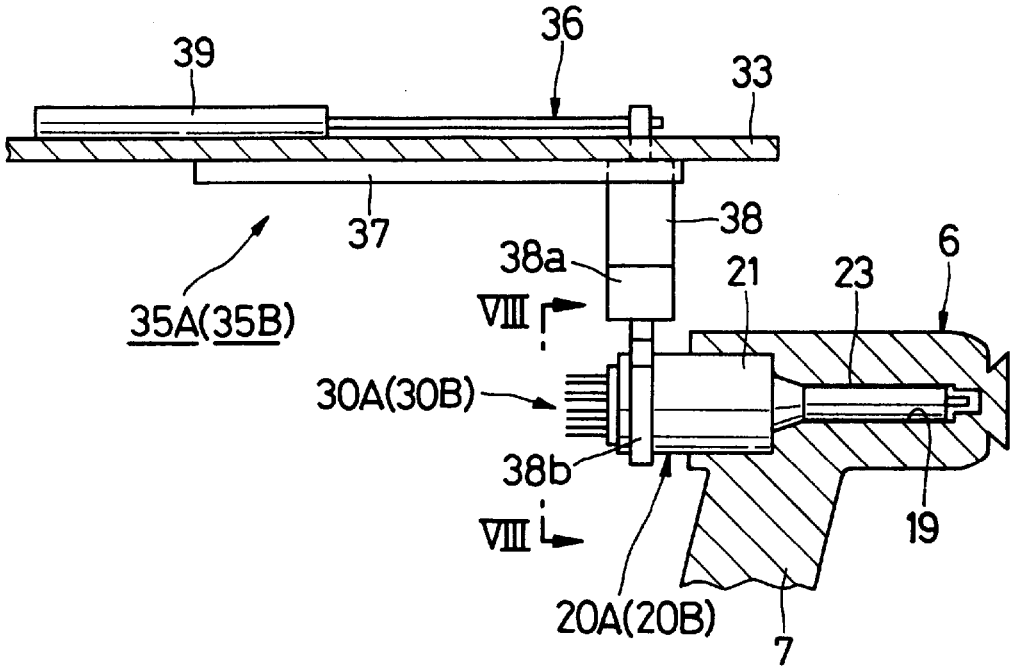
FIG. 7 is an enlarged sectional view similar to FIG. 5, showing the feeder unit gripper which is now located on the outer peripheral side of the feeder unit.
Figure 8:
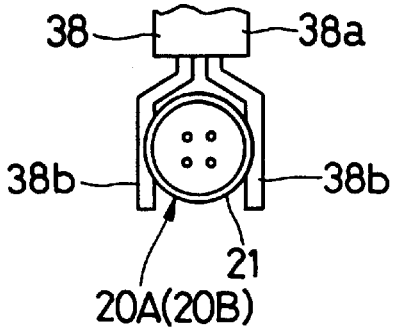
FIG. 8 is a side view taken in the direction of arrows VIII—VIII of FIG. 7, showing the feeder unit which is now gripped by the feeder unit gripper.

Therefore, in order to replace the feeder unit 20A of color A by the feeder unit 20B of color B, the support column 3 of the coating robot 1 is turned from position (b) to position (a) as shown in FIG. 3, thereby swinging the arm 4 about the pivoting point O. As a result, as shown in FIG. 5, the coating machine 6 is located in a unit replacing position for the waiting device 35A. In this state, as shown in FIG. 6, the gripper pawls 38*b* of the feeder unit gripper 38 of the feeder unit loader 36 are spread apart. In a next phase of operation, the air cylinder 39 is extended out to locate the gripper pawls 38*b* of the feeder unit gripper 38 on the outer periphery of the valve casing of the feeder unit 20A of color A as shown in FIG. 7. Further, as shown in FIG. 8, the gripper pawls 38*b* are moved toward each other to grip the valve casing 21 therebetween.

Figure 9:
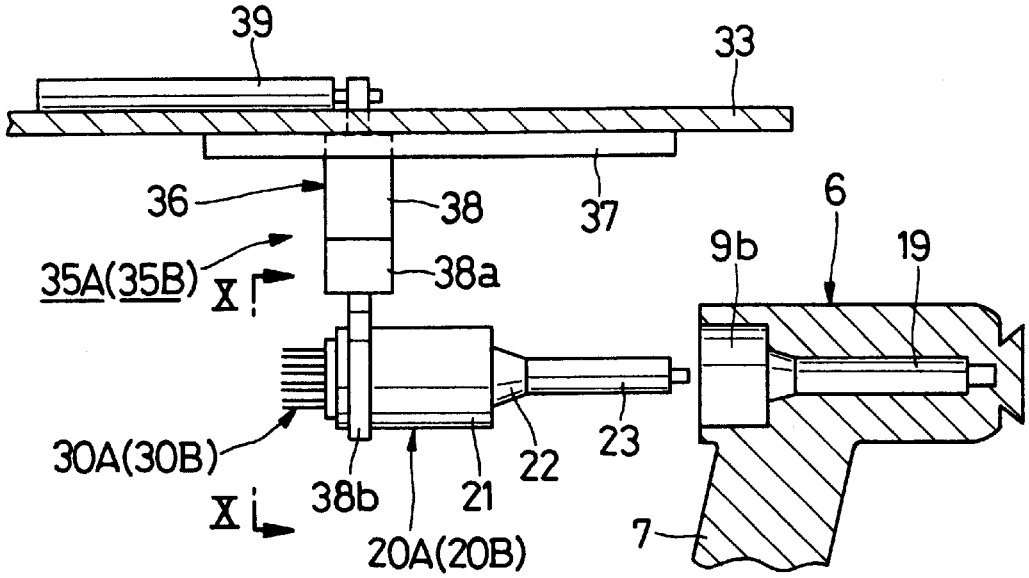
FIG. 9 is an enlarged sectional view similar to FIG. 5, showing the feeder unit which is dismantled from a housing.
Figure 10:
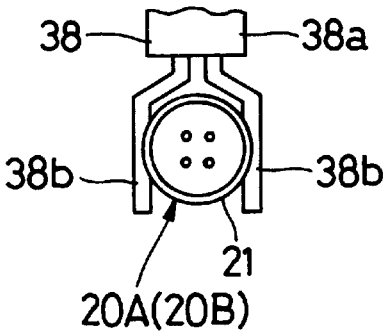
FIG. 10 is a side view taken in the direction of arrows X—X of FIG. 9, showing the dismantled feeder unit which is now being gripped by the feeder unit gripper.

In a next phase of operation, while the feeder unit 20A is being gripped by the gripper pawls 38*b*, the air cylinder 39 is contracted to extract and disengage the feeder unit 20A from the unit mounting portion 9*b* of the housing 7 as shown in FIGS. 9 and 10. As a result, the feeder unit 20A of color A is dismantled from the coating machine 6.

Figure 11:
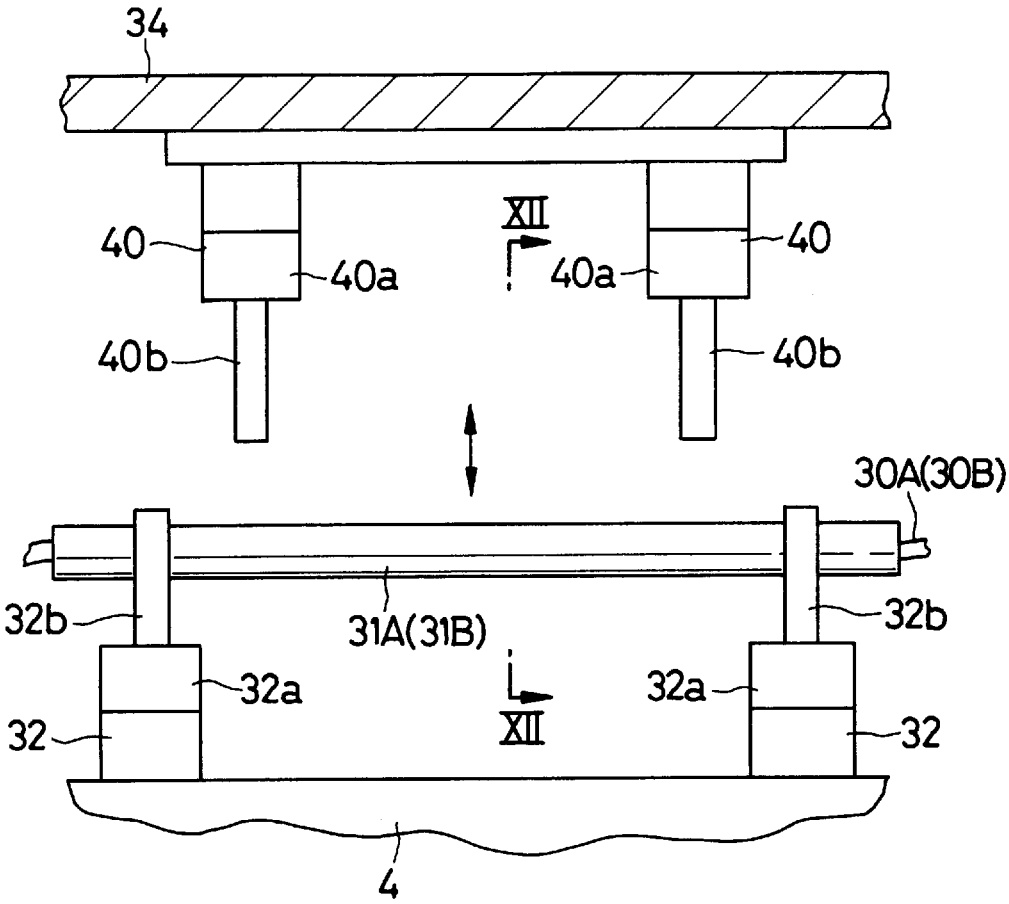
FIG. 11 is an enlarged sectional view of the arm which is now moved to a position close to a supply hose waiting plate.
Figure 12:
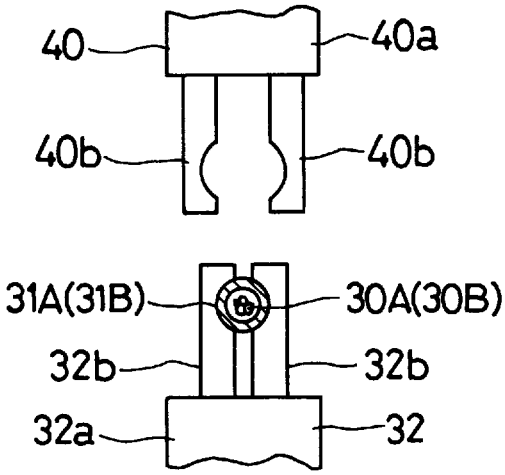
FIG. 12 is a sectional view taken in the direction of arrows XII—XII of FIG. 11, showing a hose gripper which is provided on the side of the unit waiting device and which has a pair of gripper pawls in a spread-apart open position, together with a hose gripper and a hose support pipe which are provided on the side of the arm.
Figure 13:
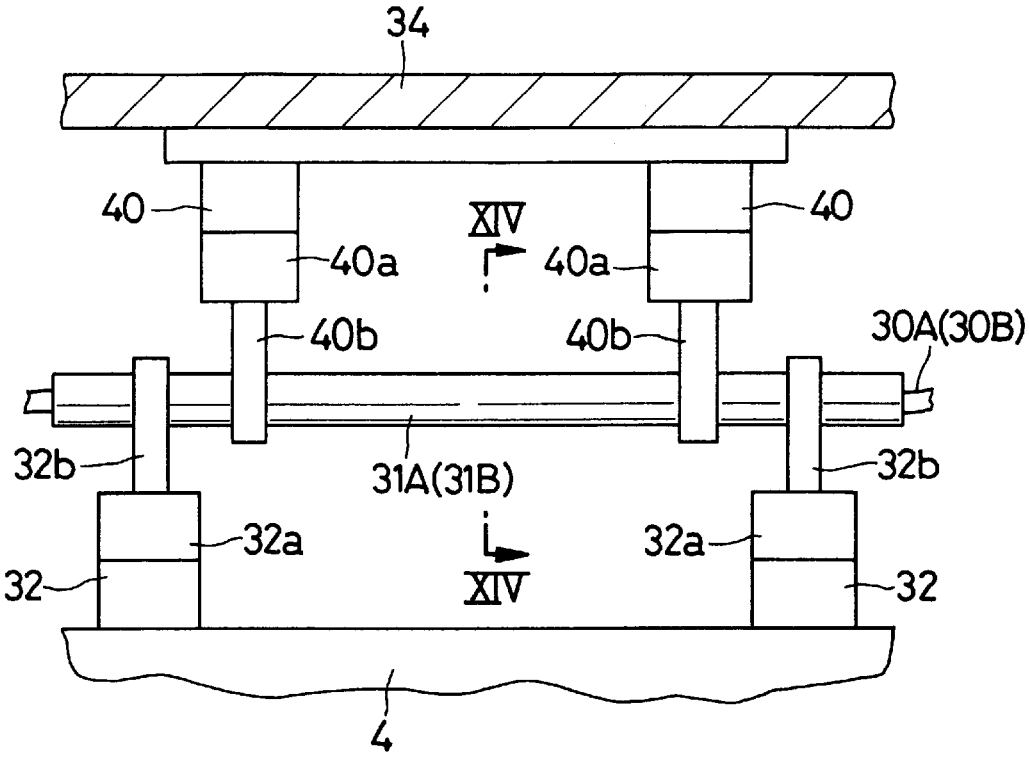
FIG. 13 is an enlarged sectional view similar to FIG. 11, showing the hose support pipe which is now being located between the gripper pawls of the hose gripper on the side of the unit waiting device.
Figure 14:
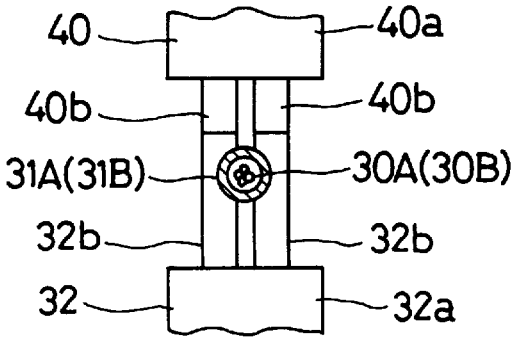
FIG. 14 is a sectional view taken in the direction of arrows XIV—XIV of FIG. 13, showing the hose support pipe which is now gripped by the pawls of the hose gripper on the side of the unit waiting device.

In the meantime, as shown in FIG. 11, as soon as the arm 4 of the coating robot 1 is brought to a position in the vicinity of the hose grippers 40 on the side of the hose waiting plate, as shown in FIG. 12, the gripper pawls 40*b* of the hose grippers 40 are spread apart. Then, as shown in FIG. 13, the hose support pipe 31A which is gripped on the hose gripper 32 on the side of the robot arm, is moved to a position between the gripper pawls 40*b*, and, as shown in FIG. 14, the paired gripper pawls 40*b* of the hose gripper 40 on the side of the waiting plate are moved toward the hose support pipe 31A (the supply hose 30A) to grip therebetween.

Figure 15:
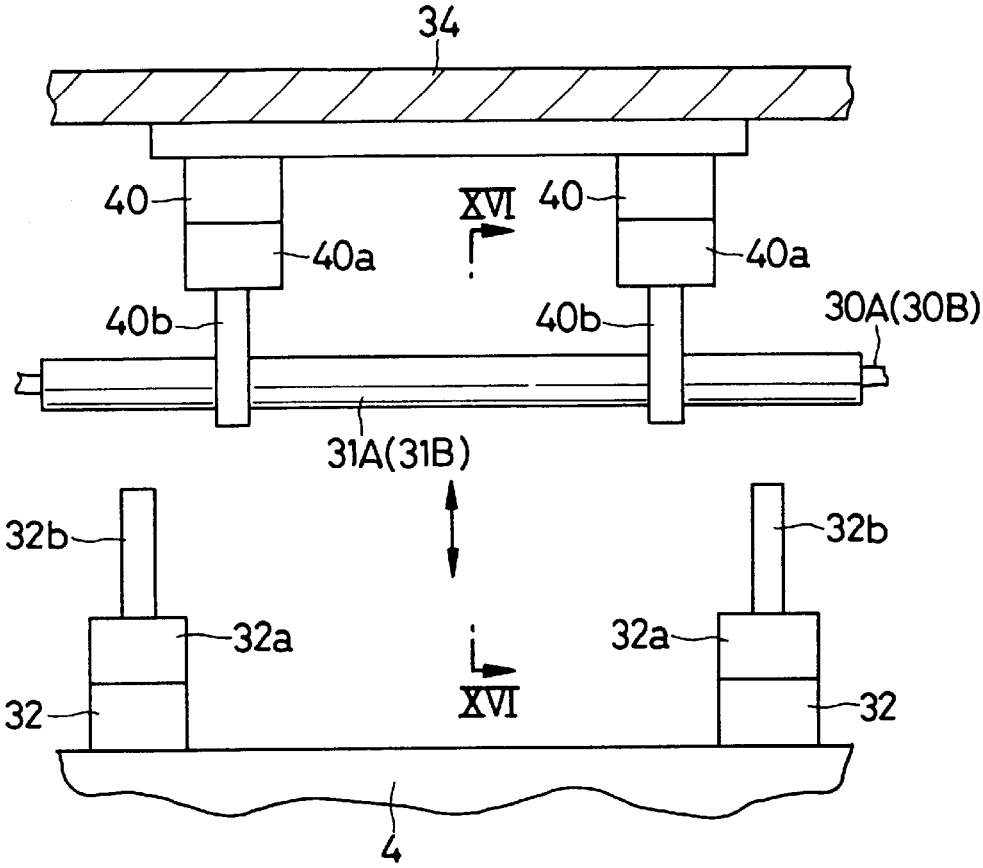
FIG. 15 is an enlarged sectional view similar to FIG. 11, showing the hose support pipe which is now handed over to the hose gripper on the side of the unit waiting device.
Figure 16:
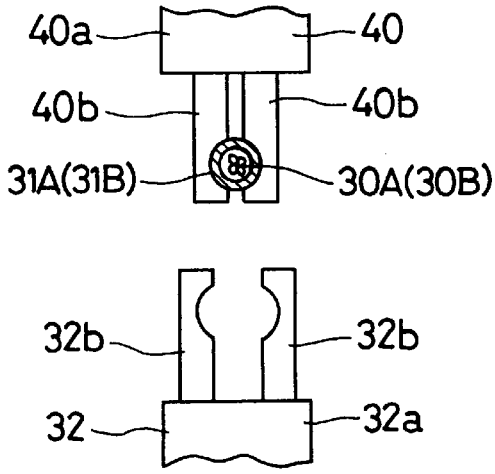
FIG. 16 is a sectional view taken in the direction of arrows XVI—XVI of FIG. 15, similarly showing the hose support pipe which has been handed over to the hose gripper on the side of the unit waiting device.

Then, as shown in FIGS. 15 and 16, the paired gripper pawls 32*b* of the hose gripper 32 on the side of the robot arm are moved away from each other, and the arm 4 is moved away from the supply hose waiting plate 34. As a result, the supply hose 30A of color A is now supported on the hose grippers 40 on the side of the waiting plate.

By the foregoing operations, the feeder unit 20A of color A and its supply hose 30A are removed from the coating machine 6 and the robot arm 4. Now, in place of the feeder unit 20A of color A which has been removed, the feeder unit 20B of color B is mounted on the coating machine 6 and its supply hose 30B is attached to the arm 4 by the following operations.

In this instance, the feeder unit 20B of the color B and its supply hose 30B are mounted in position by reversing the order of dismantling actions which have been explained above in connection with the feeder unit 20A of color A and with reference to FIGS. 5 through 16. Therefore, in the following description, a feeder unit mounting operation is explained by way of reference numerals or characters which relate to color B and which are indicated in brackets in these figures.

Firstly, the coating robot 1 is operated to turn its arm 4 and the coating machine 6 in the direction of arrow (c), thereby locating the arm 4 and the coating machine 6 in a unit replacing position confronting a color B waiting device 35B as shown in FIG. 9. In this state, as shown in FIG. 7, the air cylinder 39 is extended out to fit the valve casing 21 of the feeder unit 20B into the unit mounting portion 9*b* while inserting the feed tube 23 into the feed tube passage hole 19. As a result, the feeder unit 20B is set in position within the housing 7.

As soon as the feeder unit 20B of color B is set in position of the housing 7, the paired gripper pawls 38*b* of the feeder unit gripper 38 are spread apart to release the feeder unit 20B, and the air cylinder 39 is contracted to return the feeder unit gripper 38 to the initial position, as shown in FIGS. 5 and 6.

In the meantime, as soon as the robot arm 4 comes to a position in the vicinity of the hose grippers 40 on the side of the waiting plate as shown in FIG. 15, the paired gripper pawls 32*b* of the hose grippers 32 on the side of the robot arm are spread apart as seen in FIG. 16. Then, as soon as the hose support pipe 31B is located between the gripper pawls 32*b* as shown in FIG. 13, these gripper pawls 32*b* are moved toward each other to grip the hose support pipe 31B therebetween as shown in FIG. 14. Nextly, as seen in FIG. 12, the paired gripper pawls 40*b* hose grippers 40 on the side of the waiting plate are spread apart to release the hose support pipe 31B. Thus, the supply hose 30B of color B is now supported on the hose grippers 32 on the side of the robot arm as shown in FIG. 11.

After mounting or setting the feeder unit 20B and the hose support pipe 31B (or supply hose 30B) on the coating machine 6 and the arm 4 in this manner, the support column 3 of the coating robot 1 is turned in the direction of arrow (b) in FIG. 3 to put the coating machine 6 in the coating position. Consequently, a paint of color B is coated on the work piece 42 in the same manner as in the coating operation in color A.

Thus, according to the present embodiment, a selected one of the feeder units 20A to 20H of different colors can be replaceably mounted in position on the rotary atomizing head type coating machine 6 which is attached to a fore end portion of the arm 4, and at the same time one of the supply hoses 30A to 30H which is connected to the selected feeder unit 20A to 20H is picked up and set on the hose grippers 32 on the side of the arm.

Consequently, it becomes possible to use a plural number of feeder units 20A to 20H of different colors commonly for one and single rotary atomizing head type coating machine 6. Therefore, the paint color can be changed simply after washing off residues of a previous color adhered on the rotary atomizing head 13. Namely, it becomes possible to shorten the time for a color change, to reduce the amounts of paint and solvent to be discarded as waste, and to improve the reliability of the coating system.

Besides, while the arm 4 is being operated, the supply hose assembly 30 including paint hose 26 and solvent hose 27, is gripped in the hose grippers 32 on the side of the arm 4, and therefore prevented from getting into contact with the work piece 42 to preclude coating defects or abrasive wear or damages to the supply hose assembly 30 and to improve the reliability in performance quality.

Further, the feeder unit waiting plate 33 and the supply hose waiting plate 34 are each set up in a vertical or upright position, and the respective unit waiting device 35A to 35H are located on the front side of the waiting plates 33 and 34 at predetermined angular intervals around a pivoting point O of the robot arm 4. Accordingly, the rotary atomizing head type coating machine 6 on the robot arm can be easily and accurately located at any one of the unit replacing positions for the unit waiting device 35A to 35H simply by swinging the arm 4 through a given angle about the pivoting point O.

Furthermore, the hose grippers 32 on the side of the arm as well as the hose grippers 40 on the side of the hose waiting plate are adapted to grip the hose support pipe 31 which covers the supply hose 30. This arrangement contributes to prevent the supply hose 30 from being damaged by the hose grippers 32 and 40, thereby prolonging the durability and service life of the supply hose 30.

Although the coating machine 6 is mounted on a wrist portion 5 of the coating robot 1 which is employed as a working mechanism in the above-described embodiment, it is to be understood that the present invention is not limited to this particular arrangement. For example, the coating machine 6 can be mounted on a reciprocator or other working mechanisms if desired.

Further, in the above-described embodiment, the unit waiting devices 35 are arranged such that, when handing over a supply hose 30 to or from one unit waiting device, the hose grippers 32 on the arm 4 of the coating robot 1 are moved to a confronting position by rotation of the support column 3. However, the present invention is not limited to this particular arrangement. For instance, it is possible to provide the hose grippers on each lateral side of the robot arm 4 and to provide a unit waiting plate as well as a supply hose waiting plate on each side of the coating robot 1. In this case, since a unit waiting plate can be located on each side of the coating robot 1, it becomes possible for the coating system to handle a double number of paint sources and to cope with an increas in color.

Further, the coating robot 1 may be arranged to be movable along a predetermined path of movement or track (for the so-called tracking) along which a plural number of unit waiting devices 35 are located. In this case, it becomes possible to handle a more than two times greater number of paint colors as compared the above-described embodiment.

Furthermore, the rotary atomizing head type coting machine 6 in the above-described embodiment by way of example employs a direct charging system which is arranged to apply a high voltage directly to paint which passes through the rotary atomizing head 13. However, the present invention is not limited to a rotary atomizing head of this type. For instance, there may be employed a rotary atomizing head type coting machine with a indirect charging system, which is arranged to form a corona region around an external electrode which is provided on the outer periphery of the housing 7, and to charge paint particles with a high voltage as they pass through the corona region.

Further, in the above-described embodiment, air cylinders 39 are employed as gripper moving mechanisms. However, the air cylinders can be replaced, for example, by ball screw mechanisms or other gripper moving mechanisms if desired.

As clear from the foregoing detailed description, according to the present invention, feeder units of different colors are detachably mounted on a rotary atomizing head type coating machine, which is mounted on a fore end portion of an arm of a working mechanism, while a hose gripper is provided on the arm of the working mechanism to releasably support a paint hose by way of a hose support pipe, and further a feeder unit waiting device is provided in the vicinity of the working mechanism, the unit waiting device including feeder unit loaders each adapted to load and unload a feeder unit to and from the rotary atomizing head type coating machine and hose grippers each adapted to releasably hold a hose support pipe thereon.

As a result, the paint color can be changed in a shorted time period, simply by replacing the feeder unit which is mounted on the rotary atomizing head type coating machine. In addition, even when the arm of the working mechanism is put in swinging movements, the hose support pipe is securely gripped in the grippers on the side of the arm, thereby preventing a paint hose from hanging down loosely to cause coating defects by contact with a work piece or from getting abraded or damaged due to looseness. This contributes to prolong the service life of the paint hose and to improve the reliability in performance quality.

What is claimed is:

1. A coating system, comprising:

a working mechanism having a pivotally supported swing arm;

a rotary atomizing head type coating machine being mounted on a fore end portion of said arm of said working mechanism and having a rotary atomizing head adapted to be rotated by an air motor;

a plural number of feeder units of different paint colors adapted to be replaceably mounted on said rotary atomizing head type coating machine and each equipped with a feed tube to supply paint thereto;

paint hoses provided and connected respectively for and to said feeder units to supply paint of different colors separately from respective paint sources;

a hose support pipe fitted on each one of said paint hoses at a position anterior to a proximal end connected to said feeder unit;

a hose gripper provided on said arm of said working mechanism and adapted to releasably grip and support one of said paint hoses by way of said hose support pipe; and unit waiting devices located in the vicinity of said working mechanism and adapted to hold said feeder units and paint hoses in respective waiting positions;

said unit waiting devices being provided with a plural number of feeder unit loaders adapted to load and unload one of said feeder units into and out of said rotary atomizing head type coating machine, and said hose grippers adapted to releasably grip said hose support pipe of said paint hose to be handed over to and from said hose gripper on the side of said arm.

2. A coating system as defined in claim 1, wherein said unit waiting devices are arranged radially at angular intervals around a pivoting point of said arm.

3. A coating system as defined in claim 2, wherein said rotary atomizing head type coating comprises a feed tube passage hole for receiving a feed tube of said feeder unit when the latter is loaded thereinto, and said feeder unit loaders comprise a feeder unit gripper adapted to grip one of said feeder units therein and a gripper moving mechanism adapted to move said feeder unit gripper axially toward and away from said feed tube passage hole at the time of loading or unloading said feeder unit into or out of said rotary atomizing head type coating machine.

4. A coating system as defined in claim 2, wherein said rotary atomizing head type coating machine comprises a feed tube passage hole formed axially through a rotational shaft of said air motor, and said feeder unit loaders of said unit waiting devices are adapted to move a feed tube of one of feeder units into and out of the feed tube passage hole from behind said coating machine at the time of loading or unloading said feeder unit into or out of said coating machine.

5. A coating system as defined in claim 2, wherein said hole grippers on the side of said arm as well as said hose grippers on the side of said unit waiting devices are each constituted by a pair of gripper pawls operated by an actuator.

6. A coating system as defined in claim 1, wherein said hose grippers on the side of said arm as well as said hose grippers on the side of said unit waiting devices are each constituted by a pair of gripper pawls operated by an actuator.

7. A coating system as defined in claim 1, wherein each one of said feeder units is provided with a solvent hose, side by side with said paint hose, for supplying therethrough a solvent to be used for washing a rotary atomizing head of said coating machine.

8. A coating system as defined in claim 1, wherein said rotary atomizing head type coating machine comprises a feed tube passage hole for receiving a feed tube of said feeder unit when the feeder unit is loaded thereinto, and said feeder unit loaders comprise a feeder unit gripper adapted to grip one of said feeder units therein and a gripper moving mechanism adapted to move said feeder unit gripper axially toward and away from said feed tube passage hole at the time of loading or unloading said feeder unit into or out of said rotary atomizing head type coating machine.

9. A coating system as defined in claim 1, wherein said unit waiting devices comprise a feeder unit waiting plate and a supply hose waiting plate, each located in the vicinity of said working mechanism and within an operative range of said arm, said feeder unit loaders being located on said feeder unit waiting plate radially at angular intervals around a pivoting point of said arm, and said hose grippers on the side of said unit waiting devices being located on said supply hose waiting plate radially at angular intervals around said pivoting point of said arm.

10. A coating system as defined in claim 9, wherein said rotary atomizing head type coating comprises a feed tube passage hole for receiving a feed tube of said feeder unit when the latter is loaded thereinto, and said feeder unit loaders comprise a feeder unit gripper adapted to grip one of said feeder units therein and a gripper moving mechanism adapted to move said feeder unit gripper axially toward and away from said feed tube passage hole at the time of loading or unloading said feeder unit into or out of said rotary atomizing head type coating machine.

11. A coating system as defined in claim 9, wherein said rotary atomizing head type coating machine comprises a feed tube passage hole formed axially through a rotational shaft of said air motor, and said feeder unit loaders of said unit waiting devices are adapted to move a feed tube of one of feeder units into and out of the feed tube passage hole from behind said coating machine at the time of loading or unloading said feeder unit into or out of said coating machine.

12. A coating system as defined in claim 9, wherein said hole grippers on the side of said arm as well as said hose grippers on the side of said unit waiting devices are each constituted by a pair of gripper pawls operated by an actuator.

13. A coating system as defined in claim 1, wherein said rotary atomizing head type coating machine comprises a feed tube passage hole formed axially through a rotational shaft of said air motor, and said feeder unit loaders of said unit waiting devices are adapted to move a said feed tube of one of feeder units into and out of a feed tube passage hole from behind said coating machine at the time of loading or unloading said feeder unit into or out of said coating machine.

* * * * *